US006038906A

United States Patent [19]

Hartung et al.

[11] Patent Number: 6,038,906

[45] **Date of Patent: *Mar. 21, 2000**

[54] ROLL STAND FOR STRIP ROLLING

[75] Inventors: Hans-Georg Hartung, Pulheim; Jochen Münker, Erkrath; Hans-Peter Richter, Friedewald, all of Germany

[73] Assignee: SMS Schloemann-Siemag Aktiengesellschaft, Düsseldorf, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/882,876

[22] Filed: Jun. 26, 1997

[30] Foreign Application Priority Data

Jul. 3, 1996 [DE] Germany ..... 196 26 565

[51] Int. Cl.[7] ..... B21B 13/14; B21B 31/18

[52] U.S. Cl. ..... 72/241.8; 72/247

[58] Field of Search ..... 72/237, 240, 241.2, 72/241.4, 241.8, 242.2, 243.2, 247, 248

[56] References Cited

U.S. PATENT DOCUMENTS 2,187,250 1/1940 Sendzimir .
4,407,151 10/1983 Gronbech ..... 72/247

FOREIGN PATENT DOCUMENTS 3038865 12/1982 Germany .
3637206 5/1987 Germany .

OTHER PUBLICATIONS

Patent Abstracts of Japan, vol. 010, No. 105 (M–471), Apr. 19, 1986 & JP 60 238006 A (Ishikawajima Harima Jukogyo KK), Nov. 26, 1985.

Patent Abstracts of Japan, vol. 010, No. 153 (M–484), Jun. 3, 1986 & JP 61 007006 A (Ishikawajima Harima Jukogyo KK), Jan. 13, 1986.

Patent Abstracts of Japan, vol. 012, No. 286 (M–727), Aug. 5, 1988 & JP 63 063501 A (Hitachi Cable Ltd.), Mar. 19, 1988.

Patent Abstracts of Japan, vol. 012, No. 478 (M–775), Dec. 14, 1988 & JP 63 199003 A (Hitachi Cable Ltd.), Aug. 17, 1988.

Patent Abstracts of Japan, vol. 012, No. 251 (M–718), Jul. 15, 1988 & JP 63 036910 A (Hitachi Cable Ltd.), Feb. 17, 1988.

Database WPI, Section Ch, Week 7748, Derwent Publications Ltd., London, GB & JP 52 125 447 A (Ishikawajima Harima Jukogyo KK), Oct. 21, 1977.

Patent Abstracts of Japan, vol. 006, No. 184 (M–157), Sep. 21, 1982 & JP 57 091811 A (Kubota Ltd), Jun. 8, 1982.

Patent Abstracts of Japan, vol. 011, No. 323 (M–634), Oct. 21, 1987 & JP 62 107804 A (Hitachi Cable Ltd.), May 19, 1987.

*Primary Examiner*—Rodney C. Butler
*Attorney, Agent, or Firm*—Friedrich Kueffner

[57] ABSTRACT

A roll stand with work rolls supported by a back-up roll either directly or through an intermediate roll, particularly work rolls which are axially displaceable in opposite directions, wherein at least one of the rolls of the roll stand is constructed with varying resilience over the length thereof, particularly with a greater flattening behavior in at least a portion thereof. For this purpose, at least one of the rolls has in the area between the roll neck and the outer surface of the roll at least one notch extending concentrically about the axis.

1 Claim, 6 Drawing Sheets

ROLL STAND FOR STRIP ROLLING

BACKGROUND OF THE INVENTION

1. Field of the Invention

The present invention relates to a roll stand with work rolls which may rest against a back-up roll either directly or through an intermediate roll, particularly work rolls which are axially displaceable in opposite directions.

2. Description of the Related Art

In rolling technology, strips and sheet metal are desired which are planar with respect to their length, width and thickness and which are within increasingly narrow tolerances. While this requirement is solved by known roll stands in a satisfactory manner with respect to the center areas of the strips and sheet metal, section anomalies of the strip occur in the areas near the edges thereof. The reason for this is the drop of the elastic roll deformation from the loaded area to the unloaded area next to the strip. This upper limit beginning in the area of the strip edge leads in connection with local widening of the strip to edge sharpening of the rolled strip and an attendant decrease of the strip thickness in the edge area, i.e., the so-called edge drop.

The better the friction between the rolls and the rolling stock and the thinner the work rolls are, the more sudden this thickness change of the strip will occur. The stronger the rolling stock and the thicker the work rolls are, the greater the thickness drop at the strip edges will be. For example, during cold rolling, this area of roll sharpening of strips of 1250 mm will extend over an edge area having a width of about 15–40 mm which, in the case of poor friction between the rolls and the rolling stock as it frequently occurs as a result of rough rolls in the last stand of a tandem train, can increase to an area more than 40 mm away from the strip edges. Consequently, a portion of this sharpened edge area having an uneven thickness is usually removed by trimming the strips. This trimming of the strip requires another work step and, thus, corresponding costs, and the trimming results in an additional scrap portion.

DE 30 38 865 C1 discloses a roll stand with a pair of work rolls which are axially displaceable in opposite directions and, if necessary, with intermediate rolls and back-up rolls, wherein, inter alia, the strip edge pressure can be reduced without effort. In this roll stand, each of the displaceable rolls has at least over a portion of the length of its roll body a curved contour which deviates from a straight line extending parallel to the axis, wherein the curve contour extends preferably over the entire length of the roll body and wherein the contours of the two rolls of the pair of rolls supplement each other without a gap exclusively in a certain axial position of the rolls. This makes it possible to influence the configuration of the roll gap and, thus the cross-sectional shape of the rolled strip even by carrying out small displacement paths of the rolls having the curved contours, and thus, to reduce the edge pressure for preventing the sharpening of the edges; however, the influence on the strip edges is possible only when a treatment of the entire strip is carried out.

In accordance with another known solution for reducing edge sharpening and the resulting scrap portion, a roll stand has been proposed with two work rolls which conically narrow at an end thereof, wherein one of these rolls is combined with another roll turned by 180°. The pair of rolls is positioned in such a way that the strip edges of the rolling stock are located in the area of the beginning of the conical portion. Since the roll gap opens in the edge area as a result of the conical contour, the strip edge is being reduced to a lesser extent than would occur normally as a result of the roll flattening between the loaded part of the roll surface and the unloaded part next to the strip. However, this method has the disadvantage that the strip may crack when the strip slightly runs off as it is quite usual to happen. The reason for this is that the rolls are not moved up and, thus, a significantly decreased reduction and great tensile stresses occur on that side of the strip to which the strip runs.

Accordingly, for rolling mill operators the reduction of the scrap portion due to trimming resulting from the reduction of the edge drop is frequently not of major significance, but rather the increase of the operational safety, inter alia, by the avoidance of strip cracks. Experience has shown that these cracks can be prevented by long strip edges which may be slightly undulated and, thus, not subjected to tensile load. However, under usual conditions, an overproportional elongation of the strip limited to the strip edge area is not possible or only insufficiently possible by means of adjusting systems which influence the planar position, for example, roll displacement systems, roll bending systems or thermal systems. An exception are only rolls with very thin work rolls in which the planar position can be influenced near the strip edge; however, it remains essentially impossible to influence the strip center.

Therefore, the known measures are not sufficient to meet the increased requirements with respect to section accuracy and surface evenness of the strip edges and simultaneously to avoid strip cracks.

SUMMARY OF THE INVENTION

Therefore, it is the primary object of the present invention to provide a roll stand of the above-described type in which the strip edge geometry can be influenced with respect to section accuracy and surface evenness and in which the strip edge pressure and strip sharpening are reduced and strip cracks can be prevented.

In accordance with the present invention, at least one of the rolls of the roll stand is constructed with varying resilience over the length thereof, particularly with a greater flattening behavior in at least a portion thereof.

The present invention makes it possible to achieve in the portion of the roll having the greater resilience a greater flattening and also oval-shaping as compared to the remaining portion of the roll. In the less resilient portion, a greater effective work roll radius with corresponding reduction can be achieved, so that this strip area has a longer finished length than the adjacent area of the strip. Simultaneously, an isolated strip edge treatment can be carried out. This is because the roll flattening behavior in the area of the strip edges can be changed in such a way that an indirect evenness control of the strip edges is achieved.

While in rolls having a continuous solid cross-section the flattening at the strip edge due to the remote effect (mattress effect) of the unloaded roll surface next to the strip to be rolled is too small and, thus, the local roll diameter in the edge area and the attendant edge pressure are too great, the roll according to the present invention makes it possible to achieve a greater flattening at the strip edges which causes the strip thickness to be uniform in width direction.

Since it is now possible to influence the flattening behavior and the radius formation of the rolls, the strip edge thickness can be influenced indirectly and, thus, the negative edge sharpening of the strip can be avoided. It is no longer necessary to trim the strips and the high scrap portion resulting from trimming no longer occurs and simultaneously, the service life of the rolls is increased. On the other hand, the danger of strip cracks is reduced particularly in the case in which the strip does not run symmetrically with respect to the middle of the pair of work rolls, even if the travel of the strip should be controlled in a preferred manner for the purpose of the strip edge-oriented readjustment of the rolls. As a result, the rolls according to the present invention do not act in the manner of the above-described rolls through an asymmetrical thickness adjustment and, thus, directly, but through an indirect influence in the form of different flattenings and radii with the aforementioned advantageous effects on the strip edges and the total strip.

In accordance with a further development of the present invention, the roll is composed of a roll core extending over a partial length of the roll body, wherein the roll core has a lower modulus of elasticity than a roll casing surrounding the roll core. If such a roll, which, for example, is composed in one roll section of a combination of the roll core having a lower modulus of elasticity (for example, gray cast iron) and a roll casing having a higher modulus of elasticity (for example, steel) and an adjacent portion composed completely of the material of the roll casing, is used in a strip edge-oriented manner, the planar position in the strip middle can be influenced and, essentially independently therefrom, the evenness of the strip edges can be influenced.

In accordance with an advantageous embodiment of the invention, at least one of the rolls has in the area between the roll neck and the outer surface of the roll at least one notch extending concentrically about the axis. This structural configuration makes it especially possible to carry out an isolated strip edge treatment. The manner of operation of the roll is based on the different flattening behavior of the roll body having the concentric notch and the resulting hollow roll area near the surface of the roll or the solid portion of the roll extending toward the roll middle. By providing, in accordance with the present invention, a notch on one side or on both sides, a greater flattening can be achieved in the area of the strip edges by the lacking inner support of the roll area near the outer surface resulting from the removal of material.

It is basically possible to provide the roll according to the present invention with a flattening only at one roll end or roll neck end. By providing a preferred combination with another axially displaceable roll of equal construction, it can be ensured that a strip edge-oriented positioning can be carried out essentially independently of the strip width, because such an influence of the flattening behavior now occurs at each roll and, thus, at both strip edges.

In accordance with a recommended feature, in a roll provided with a notch according to the present invention, the annular notch is provided at the transition between the roll neck and the adjacent roll body. However, any other arrangement of the location of the incision in the area between this transition toward the outer surface is conceivable. The notch can also be located in the immediate vicinity of the outer surface of the roll; however, in that case it must be ensured that the roll area near the outer surface still has sufficient thickness to prevent the danger of cracks.

In the case of a notched roll, the notch preferably extends from the end face of the roll toward the middle of the roll. The length of the notch can be adapted to different rolls and the required roll properties of the rolling stock for an optimum influence of the flattening behavior of the rolls and the effect on the strip edges, i.e., reduction of the edge pressure and avoidance of strip sharpening. A further optimization results from the advantageous axial displacement of the pair of rolls in opposite directions as already mentioned above.

In a roll provided with a notch in accordance with the present invention, the removal of the material at the end of the roll results in an outer roll portion near the outer surface of the roll and an inner roll portion at the axis of the roll. The outer roll portion is constructed so as to be hollow as a result of the notch, so that, by utilizing the elastic behavior of the material, it is possible that the outer roll portion can be moved into the hollow space when an external load is applied during the rolling process. Consequently, the outer contour of the roll is flattened in this area. This configuration is not limited to a concentric, annular notch on each end face of the roll body. Rather, it is possible to provide several concentric notches in the end face of the roll body.

In addition to roll bodies having a notch at one end, it is conceivable to provide notches extending concentrically about the axis of rotation on both ends in the roll body in the areas between the roll necks and the outer surface of the roll. Among possible combinations are the use of two rolls having a notch at both ends, or the use of a conventional roll with a roll having a notch at both ends.

The shape of the concentric notch can be selected as desired. The selection preferably is based on the desired characteristic of the roll body and can be predetermined in an optimum manner using finite element computations.

In accordance with an embodiment of the present invention, the notch surface which is closer to the axis of the roll in radial direction extends parallel to the roll axis, while the notch surface located closer to the outer surface of the roll tapers inwardly toward the bottom of the notch.

In accordance with another embodiment, the notch surface near the roll axis as well as the notch surface near the roll surface extend parallel to the roll axis to the notch bottom and, thus, have a constant distance between each other as seen over the cross-section.

In a different embodiment, it is also possible that the notch does not extend essentially parallel to the roll axis; rather, the notch may extend from the end face of the roll body toward the roll axis or toward the roll surface, i.e., the notch may be divergent or convergent.

The outer contour of the notched roll can be selected as desired. In the unloaded state, the outer contour of the roll portion with the full cross-section continues in the outer contour of the notched end portion. For example, the roll may be cylindrically shaped or drum-shaped and have a conventional camber. On the other hand, special shapes are also conceivable, such as, a continuous variable crown or CVC contour. Generally, there are no limits with respect to shape and condition of the outer surface of the roll; the roll may have any contour.

While the roll provided with a notch according to the present invention, after suitable strip edge-oriented positioning, is subject to greater flattening and, thus, reduces the strip edge sharpening due to the lack of internal support of the roll casing in the area of the strip edge, another aspect of the present invention provides for making the total elasticity of the edge areas of the roll body so as to be variably adjustable through the selection of the material or the composite material of a filler element which fully or partially fills out the notch. The total elasticity of the edge area is then the addition of the elasticity of the roll body casing and the elasticity of the filler element. The material of the filler element has a lower modulus of elasticity than the roll body in order to achieve a more elastic roll edge area.

The filler element may be preferably provided as a plug or sleeve which is inserted from the edge into the notch or another turned-out portion of the rolled body.

Steels with better elastic properties than the roll material may be used as the material for the filler element, i.e., for the plug or the sleeve. In addition, the use of other metals, high temperature synthetic materials or a combination of materials is possible. This increases the possible variations of the flattening behavior of the roll in the edge area thereof. Moreover, an advantageous effect is achieved in that the parts of the roll which are not in contact with the strip but are in support contact are subjected to a lesser extent to a beating process. For influencing the flattening behavior of the rolls and the adaptation of the rolls to the properties and requirements of the material being rolled, the embodiment with such insert elements utilizes the damping influence of the appropriately selected material of the filler element.

The principle of a roll with different resiliencies over the length thereof can also be realized, in accordance with another proposal according to the present invention, by arranging on at least one roll neck a sleeve of a material with another modulus of elasticity than the remaining roll body. In accordance with another embodiment of the present invention, a roll may have a roll casing of varying thickness, so that the total resilience continuously changes in accordance with the gradual change of the thickness of the roll casing.

It is possible in all cases to utilize the different resilience and the correspondingly different flattening behavior also directly for influencing the evenness, for example, when the intermediate rolls or the back-up rolls of a roll stand are constructed with different resilience along the strip.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
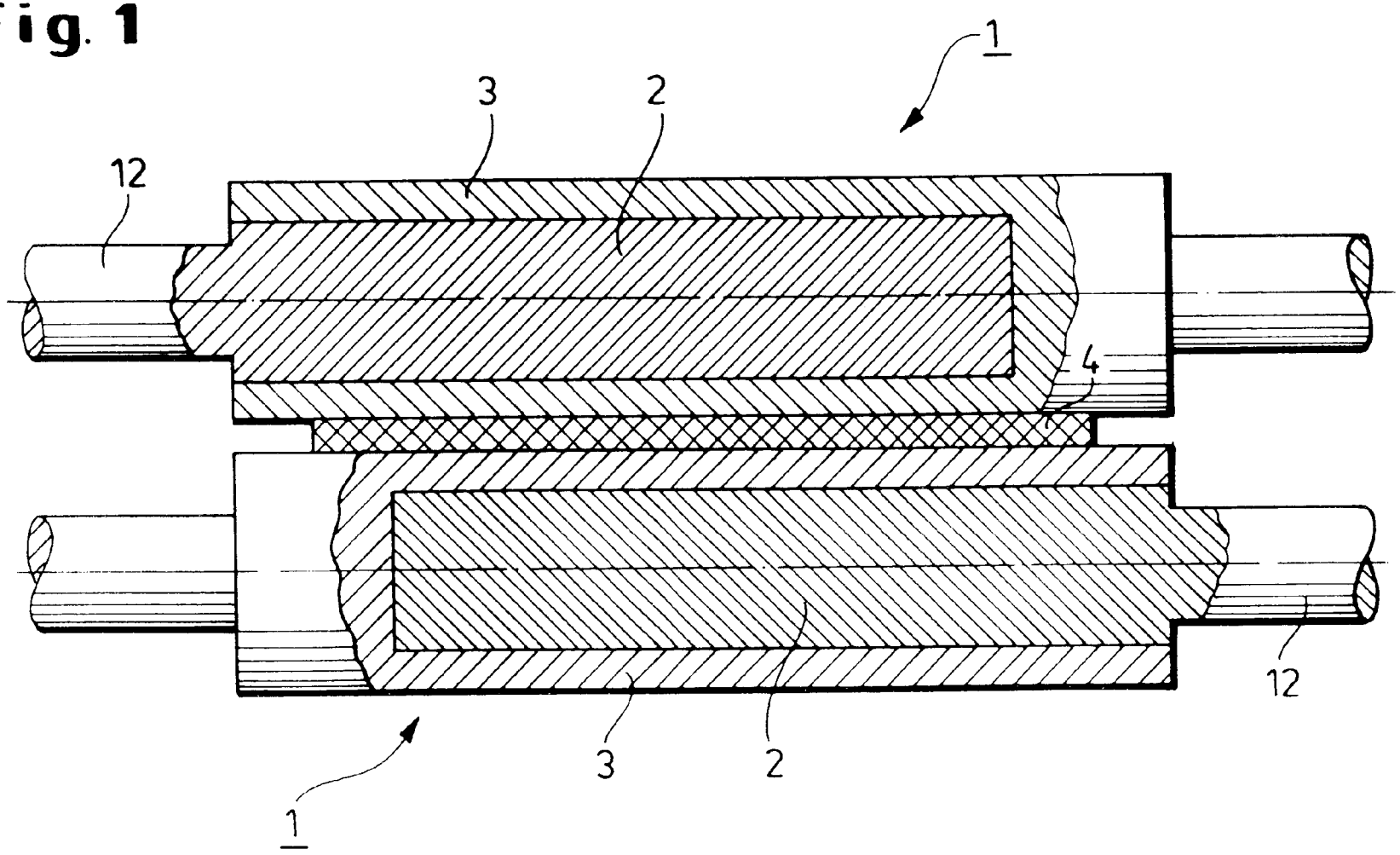
FIG. 1 is a side view, partially in section, of a pair of work rolls, wherein the rolls are constructed in accordance with a first embodiment of the present invention.

FIG. 1 of the drawing shows two axially displaceable rolls 1 which are arranged in an oppositely directed configuration. Each roll 1 is composed of a roll core 2 which extends over a partial length of the roll body and which has a lower modulus of elasticity than a roll casing 3 surrounding the roll core 2. While the roll core 2 is, for example, of grey cast iron, the roll casing 3 may be of steel. The resulting higher resilience of the material of the roll core 2 causes in the section of the roll 1 with the roll core 2 to be flatter and more oval than in the adjacent area which is completely of the less resilient material. In this section having a full cross-section of steel, the result is a greater effective radius of the rolls with a greater thickness reduction of a metal strip 4 to be rolled in these areas, so that this strip portion has a greater finished length than the adjacent portion of the strip; this increases the operational safety during the rolling process, particularly and most importantly by avoiding strip cracks because an overproportional elongation of the strip which is limited to the immediate strip edge region can be achieved and, thus, the tension load acting on the strip edges can be reduced or eliminated; simultaneously, as a result of the resilience of the rolls 1 in the remaining portions, the strip edge sharpening is reduced.

Figure 2:
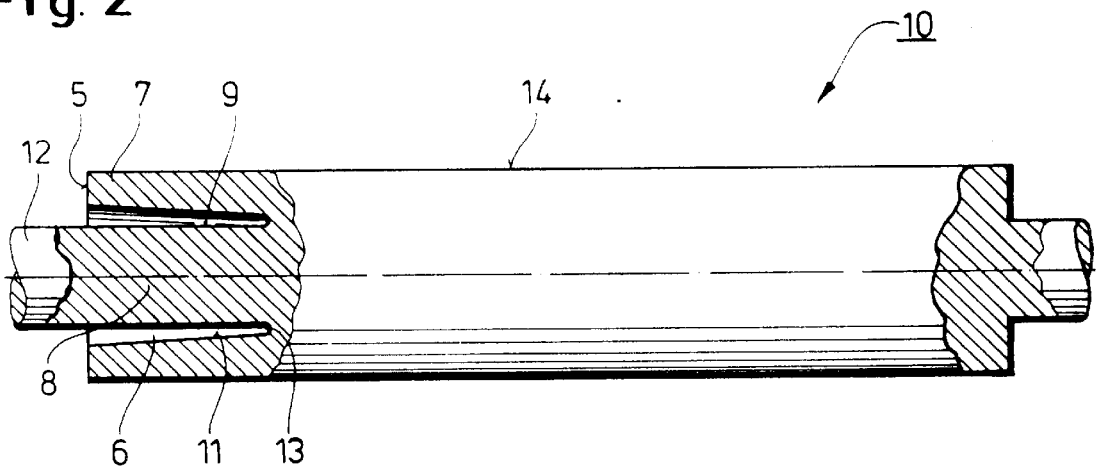
FIG. 2 is a side view, partially in section, of another embodiment of the roll according to the present invention.

FIG. 2 shows another embodiment of a cylindrical roll 10 which has at least in one end area thereof a greater flattening behavior of the roll body. On one end of the roll, a notch 6 extending concentrically around the axis of rotation of the roll or the roll neck 12 is provided on the end face 5 of the roll. This removal of material has the result that the roll body has an outer roll portion 7 adjacent the outer surface of the roll and an inner roll portion 8 adjacent the axis. The outer roll portion 7 is hollow in the area of the conical notch 6. In the embodiment illustrated in FIG. 2, the surface 9 of the notch near the roll axis extends parallel to the roll axis, while the notch surface 11 adjacent the roll surface tapers inwardly toward the bottom 13 of the notch. The shape 14 of the roll surface of the roll body in the area of the notch is a continuation of the contour of the roll portion having the solid cross-section, i.e., a cylindrical shape in the illustrated embodiment.

Figure 3:
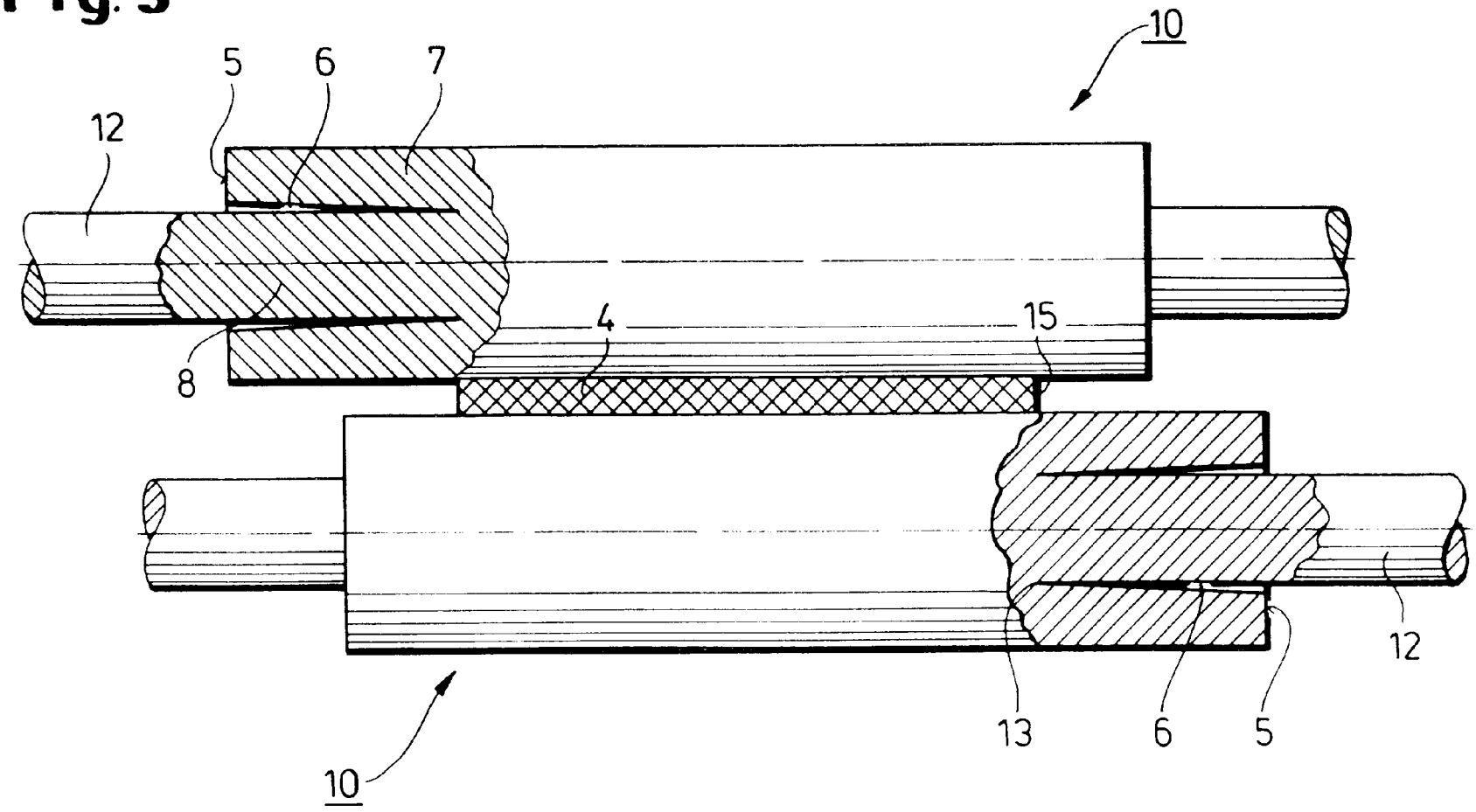
FIG. 3 is a side view, seen in rolling direction, showing a possible adjustment or arrangement of the work roll shown in FIG. 2.

FIG. 3 shows a pair of work rolls 10 which each have at one end thereof a notch 6 in the end faces 5. The rolls 10 can be displaced axially in opposite direction relative to the strip 4, so that the respective bottom 13 of the notch is located in a suitable position relative to the respective strip edge 15. In the embodiment illustrated in FIG. 3, this is achieved by arranging the bottom 13 of the notch approximately on the level of the strip edges 15. In contrast to a solid cross-section of the roll, the lacking internal support of the outer roll portion 7 resulting from the material removal causes during the rolling process at the strip edge 15 a significantly greater flattening of this strip area. This reduces the edge pressure and the strip thickness in width direction is rendered more uniform and, thus, edge sharpening is minimized. Because the strip edges are less sharpened, the wear of the rolls can be reduced. The scrap portion due to trimming of the strip edges which are not within the tolerance range as it was necessary in the past is reduced and the service life of the rolls used for rolling is increased.

Figure 4:
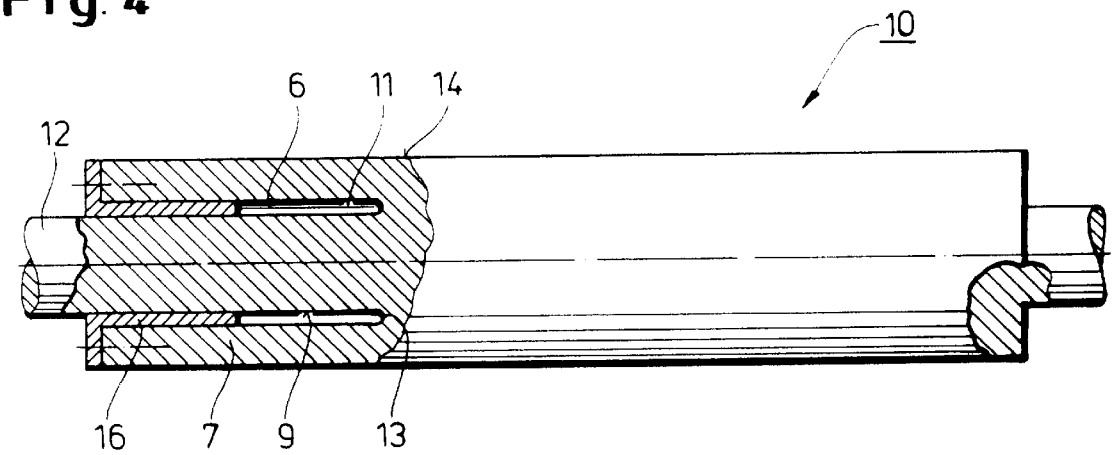
FIG. 4 is a side view showing another embodiment of the roll according to the present invention.
Figure 5:
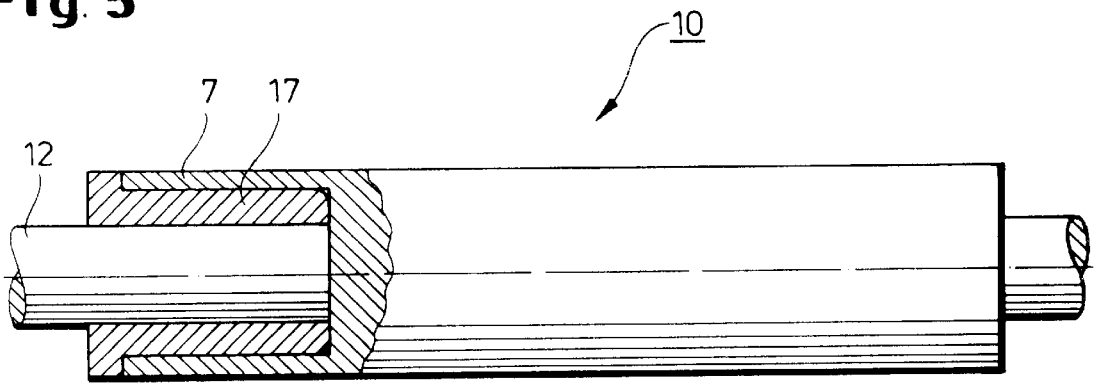
FIG. 5 is a side view, partially in section, of a roll modified as compared to the roll of FIG. 4.

FIG. 4 of the drawing shows a modified roll 10. The notch surfaces 9, 11 of the notch 6, which also in this case is provided on one end of the roll, have a constant distance between each other as seen in the cross-section up to the bottom 13 of the notch, i.e., the notch surface 9 nearer to the roll axis and the notch surface 11 nearer to the roll surface extend parallel to the roll axis or the roll neck 12. The shape 14 of the roll surface in the area of the notch 6 is cylindrical, as is the contour of the roll section having the full cross-section. A plug 16 partially filling out the notch 6 is inserted into the hollow space of the notch. As a result, the outer roll portion 7 is only partially hollow, i.e., the outer roll portion is supported only at certain locations. This is different in the roll 10 shown in FIG. 5 in which a sleeve 17 having an adjusted elasticity is inserted into the notch and completely fills out the notch and supports the outer roll portion 7.

Figure 6:
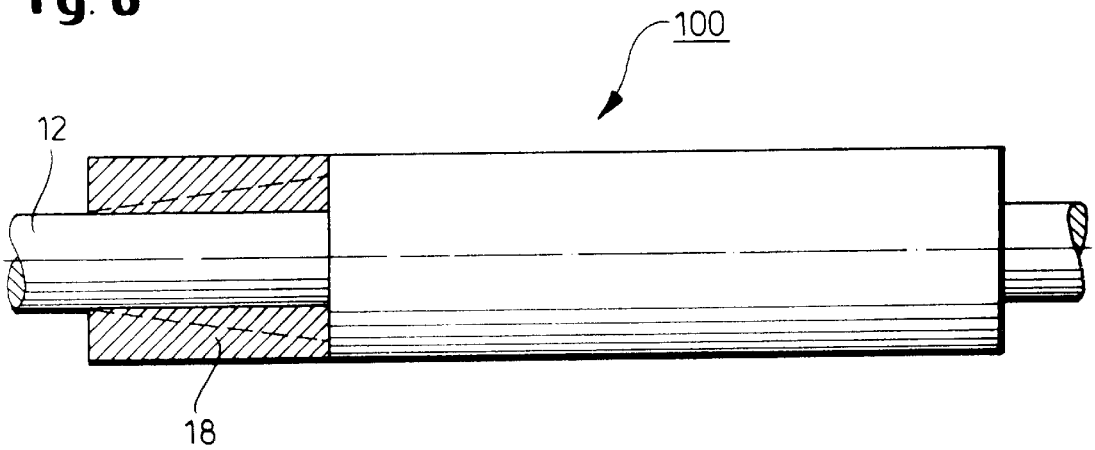
FIG. 6 is a partial sectional view of a roll with a sleeve arranged on the roll journal.

In the roll 100 shown in FIG. 6, a somewhat greater flattening and resilience over a limited portion of the length of the roll is achieved by a sleeve 18 which is slid onto the roll or roll neck 12 and which has a lower modulus of elasticity than the material of the remaining roll. The roll neck 12 may be cylindrical or, as shown in connection with the sleeve 18 in broken lines, conical which requires a corresponding contour of the sleeve 18.

Figure 7:
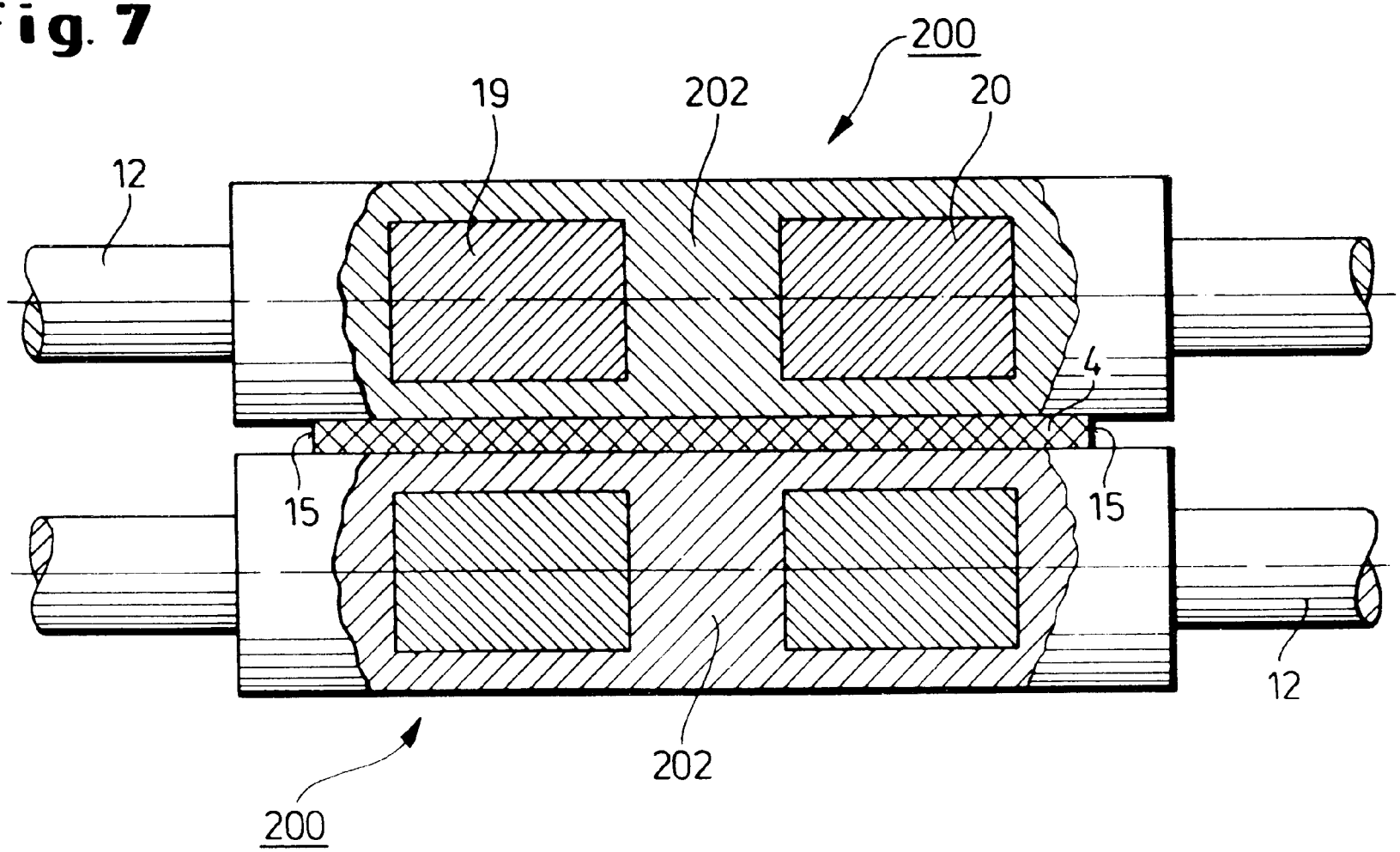
FIG. 7 is a side view, partially in section, of a pair of rolls in which the rolls are constructed with different resilience along the roll body in more than two roll portions.

In the rolls 200 shown in FIG. 7 and arranged in a pair, the principle of the different resilience along the length of the roll body is applied to more than two roll sections, especially in order to prevent strip cracks. Two filler inserts 19, 20 which are spaced apart from each other are incorporated in the roll core 202, wherein the filler inserts 19, 20 have a modulus of elasticity which is lower than that of the material of the core. This embodiment is of particular interest if it is desired to influence a specific local planar position for strip areas other than the strip edges 15.

Figure 8:
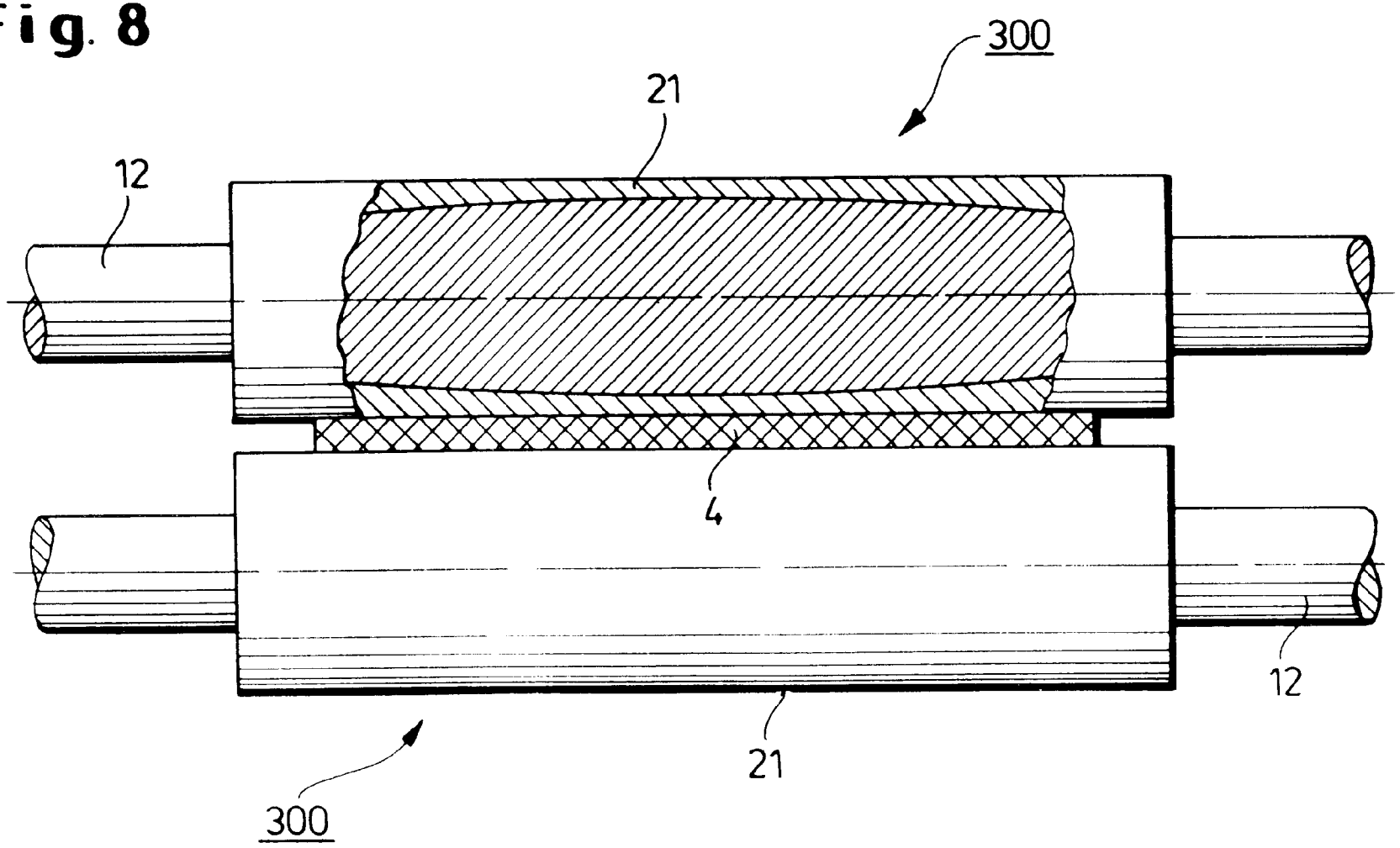
FIG. 8 is side view, partially in section, of a pair of rolls, wherein one of the rolls is constructed in accordance with another embodiment of the present invention.

In the rolls 300 shown in FIG. 8 and arranged in a pair, the total resilience of each roll is changed as a result of a gradual change of the thickness of the roll casing 21, as shown in the cross-section of the upper roll in FIG. 8. In other words, in this case, two different materials are not utilized.

The rolls 1, 10, 100, 200 and 300 described above, which are of different construction but all have a different resilience over the length thereof, can be used in two-high stands and multi-high roll stands for cold rolling as well as hot rolling. The rolls can also be used equally well in one-way stands and reversing stands as well as in tandem trains and reversing trains.

While specific embodiments of the invention have been shown and described in detail to illustrate the inventive principles, it will be understood that the invention may be embodied otherwise without departing from such principles.

We claim:

1. A roll stand with work rolls which are cylindrical over an entire length thereof, particularly work rolls which are axially displaceable in opposite directions, the roll stand comprising at least one roll having a varying resilience over a length of the roll, wherein the at least one roll has a greater flattening behavior in at least a portion thereof, wherein the at least one roll has an axis, roll necks and an outer surface, at least one notch extending concentrically about the axis and located in an area extending between the roll neck and the outer surface of the at least one roll, wherein the roll neck has an inner end connected to a roll body, wherein the notch is conically shaped and has a bottom extending contiguous with the inner end of the roll neck, and wherein the notch has a notch surface closer to the roll axis extending parallel to the roll axis and a notch surface closer to the roll surface tapering inwardly toward the bottom of the notch.

* * * * *